United States Patent [19]

Marcon et al.

[11] Patent Number: 4,936,032

[45] Date of Patent: Jun. 26, 1990

[54] SAFETY VALVE FOR HYDRAULIC RECEIVER AND HYDRAULIC CIRCUIT COMPRISING SAME

[75] Inventors: Louis Marcon, Saint-Entienne; Maurice Tardy, Lorette, both of France

[73] Assignee: Bennies Marrel, France

[21] Appl. No.: 311,315

[22] Filed: Feb. 15, 1989

[30] Foreign Application Priority Data

Feb. 25, 1988 [FR] France ..... 88 02289

[51] Int. Cl.[5] ..... F15B 13/04

[52] U.S. Cl. ..... 137/599; 91/445

[58] Field of Search ..... 137/599; 91/445

[56] References Cited

U.S. PATENT DOCUMENTS 4,244,275 1/1981 Smilges ..... 91/445 X 4,655,039 4/1987 McCabe ..... 91/445 X

*Primary Examiner*—Robert G. Nilson

*Attorney, Agent, or Firm*—Remy J. VanOphem

[57] ABSTRACT

Safety valve for a hydraulic circuit supplying a hydraulic receiver having an inlet and an outlet connected to the receiver which includes between the inlet and the outlet a non-return module which has a non-return valve and a selectively operable valve having an unoperated position in which the non-return valve prevents any reverse flow of fluid from the outlet to the inlet and an operated position in which such reverse flow is made possible. A control inlet is provided for applying control pressure to the selectively operable valve. A pressure relief valve is provided between the outlet and the control inlet which is adapted to enable flow from the outlet to the control inlet from a predetermined pressure threshold.

11 Claims, 3 Drawing Sheets

SAFETY VALVE FOR HYDRAULIC RECEIVER AND HYDRAULIC CIRCUIT COMPRISING SAME

BACKGROUND OF THE INVENTION

The present invention relates to a safety valve designed to be fitted to a hydraulic circuit of the kind used to control machines, machine tools and construction plants, in aircraft and on various kinds of vehicles. A circuit of this kind is generally controlled by at least one hydraulic distributor.

As is well known, a hydraulic circuit of the aforementioned type usually includes flexible hoses controlling the rams or the like, for example, in order to manipulate a load. A safety problem arises should a hose supplying a ram rupture.

The invention is directed to overcoming this problem and ensuring the safety of users even in the event of rupture of a hose in a circuit controlling the manipulation of a load. In the case of manipulating loads it is particularly directed to enabling immobilization of the load during lifting and, during lowering, normal continuance of this movement and/or halting thereof on command.

To this end the invention proposes a safety valve on permanent standby normally authorizing flow of fluid in only one direction between its inlet and outlet, flow of fluid in the opposite direction requiring the application of a control pressure which is normally applied by the controller but which, in the event of rupture of a hose, can result from a pressure threshold being exceeded at the outlet.

To this end the invention further proposes a safety valve for a hydraulic circuit supplying a hydraulic receiver having an inlet and an outlet connected to the receiver and characterized in that it includes, between the inlet and outlet, a non-return module having a non-return valve and a selectively operable valve having an unoperated position in which the non-return valve prevents any reverse flow of fluid from the outlet to the inlet and an operated position in which such reverse flow is made possible. A control inlet is provided for applying control pressure to the selectively operable valve and a pressure relief valve is provided between the outlet and the control inlet from a predetermined pressure threshold.

It will be realized that a valve of this kind makes it possible to control fluid flow rates at a pressure of around 400 bars, for example, with control pressures of only 25 bars or less.

SUMMARY OF THE INVENTION

In preferred embodiments of the invention, some of which may be combined with each other, a throttle is provided near the control inlet so that in the event of a pressure surge the majority of the escaping flow rate is applied to the non-return module as control fluid.

The selectively operable valve is provided with a leakage drain leading to a leakage outlet making it possible to apply to the control pressure a counter-pressure resulting from a pressure surge. When a plurality of receivers fitted with a safety valve of this kind are used simultaneously, their behavior may be synchronized by applying appropriate counter-pressures.

The selectively operable valve has a plurality of intermediate positions between its unoperated and operated positions allowing a reverse flow rate lower than the flow rate permitted in the operated position to enable a progressive relationship between the reverse flow rate and the amplitude of the control pressure.

The non-return valve may be part of the selectively operable valve or may be included in a circuit in parallel with that including the selectively operable valve.

The selectively operable valve includes a sliding sleeve forming a slide valve, the movement of which is controlled by a valve which in turn is controlled by the piston rod of a piston operated by the control pressure.

The invention also concerns a hydraulic circuit including a valve of this kind fixed to the receiver, the distributor of which may be controlled by the pressure surge from the control inlet.

Objects, characteristics and advantages of the invention will emerge from the following description given by way of non-limiting example with reference to the appended drawings.

DETAILED DESCRIPTION OF THE PREFERRED EMBODIMENT

Figure 1:
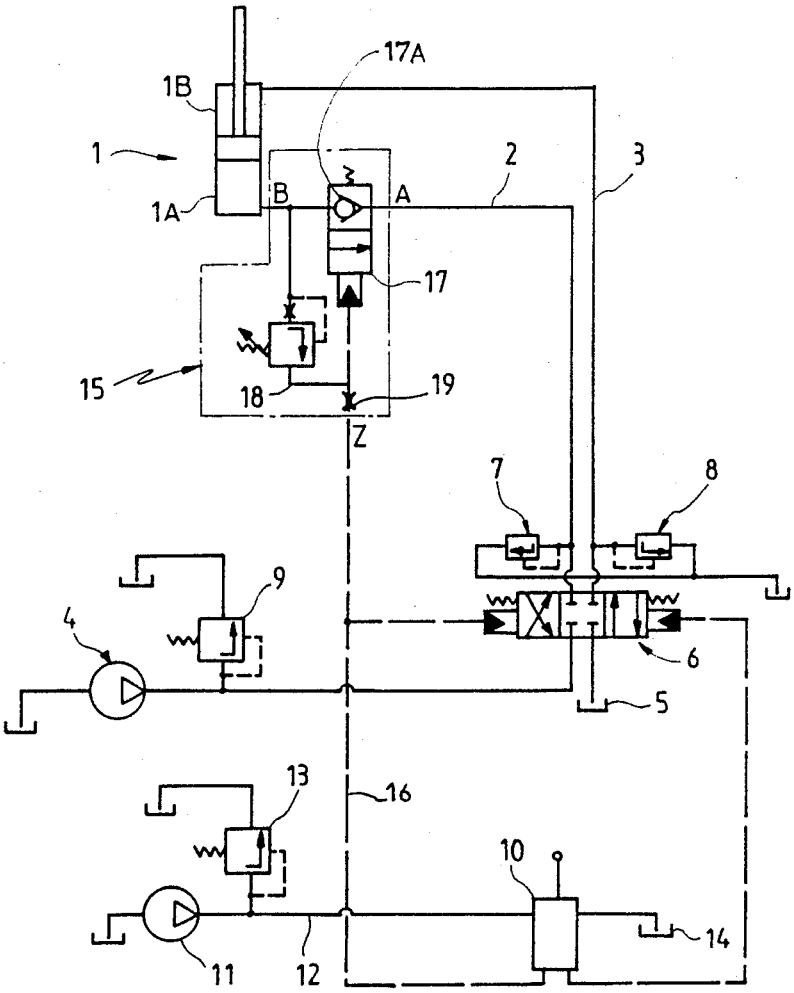
FIG. 1 is a diagram of a hydraulic receiver equipped with a safety valve in accordance with the invention and its control hydraulic circuit.

FIG. 1 shows a hydraulic receiver 1 in the form of a double-acting ram having chambers 1A and 1B which are connected by pipes 2 and 3 to a pressure source 4, in this case a pump, and to a pressure sink 5 by a distribution-switching, selectively operable valve 6. The pipes 2 and 3, which may be flexible hoses, for example, are provided with pressure relief valves 7 and 8; similarly, a pressure relief valve 9 is provided between the pressure source and the selectively operable valve 6.

The selectively operable valve 6 has three positions, respectively corresponding to pressurization of either or both of the chambers 1A and 1B of the ram.

The selectively operable valve is controlled by a manipulator 10 connected to a pressure source 11 by a pipe 12 fitted with a pressure relief valve 13 and to a pressure sink 14.

At least one of the pipes 2 and 3 (in this instance the pipe 2) is equipped with a safety valve 15 which protects the corresponding ram chamber 1A.

The safety valve 15 has three inlets A, B and Z, respectively, connected to the pipe 2, to the chamber 1A and to a control pipe 16 connected to the manipulator 10 and to the distribution-switching, selectively operable valve 6.

Between the inlets A and B is a selectively operable valve 17 including a non-return valve 17A. The selectively operable valve 17 has two positions, one of which is selected according to the control pressure applied to the inlet Z. One position (the unoperated position) corresponds to the interposition between A and B of the non-return valve 17A preventing any circulation from B to A and the other position (in the event of a non-null control pressure) enables free circulation between B and A. This valve advantageously has intermediate positions between these extreme positions authorizing flow from B to A to increase along with the control pressure.

Between the inlets B and Z is a calibrated pressure relief valve 18 enabling circulation from B to Z above a limiting threshold for the pressure in the chamber 1A. A throttle 19 is provided between this pressure relief valve and the selectively operable valve 17 and the inlet Z.

In the absence of any control pressure the chamber 1A can be pressurized through the pipe 2.

Draining this chamber requires the application of a control pressure to move the selectively operable valve 17 to its other position. In normal operation this control pressure is controlled by the manipulator.

In the event of an accidental drop in the pressure in the pipe 2 during pressurization of the chamber 1A (following rupturing of the pipe, for example) the safety valve 15 maintains the pressure in the chamber when no control pressure is supplied at the inlet Z. This makes it possible to avoid damage to any load that the ram was manipulating and injury to persons nearby.

Furthermore, the presence of the pressure relief valve 18 prevents any exaggerated increase in the pressure in the chamber 1A. This pressure immediately crosses the threshold associated with the valve, the latter authorizes a flow of fluid which, because its flow rate towards the manipulator 10 is limited by the throttle 19, induces a control pressure at the selectively operable valve 17, the amplitude of which commands a greater or lesser flow rate from B to A until the pressure in the chamber 1A falls below the aforementioned threshold, which returns the pressure relief valve 18 to the blocking condition. This results in slow and limited draining of the chamber 1A.

Note that the escape flow rate through the inlet Z in the event of an accidental drop in the pressure and in the absence of any action at the manipulator 10 automatically commands movement of the selectively operable valve 6 to its neutral position which stops any injection of hydraulic fluid into the pipe 2.

Figure 1A:
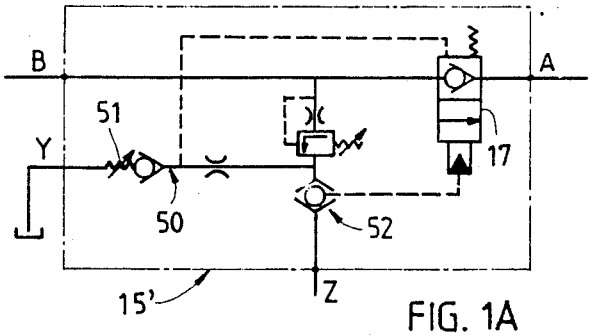
FIG. 1A is a diagram showing an alternative embodiment of the safety valve.

FIG. 1A shows in isolation an alternative embodiment 15' of the safety valve of FIG. 1.

The alternative safety valve 15' differs from the previously described safety valve 15 due to the presence of a leakage drain 50 which provides communication between a counter-pressure chamber associated with the selectively operable valve 17 and a leakage outlet Y. An adjustable threshold non-return valve 51 is advantageously provided on this drain. By adjusting the threshold, the counter-pressure opposing the control pressure to control the selectively operable valve can be altered. This facilitates coordinated control of a plurality of safety valves. Also, the control chamber of the selectively operable valve 17 is controlled by a member 52 adapted to have only control fluid from the pressure relief valve 18 or the inlet Z pass therethrough.

Figure 3:
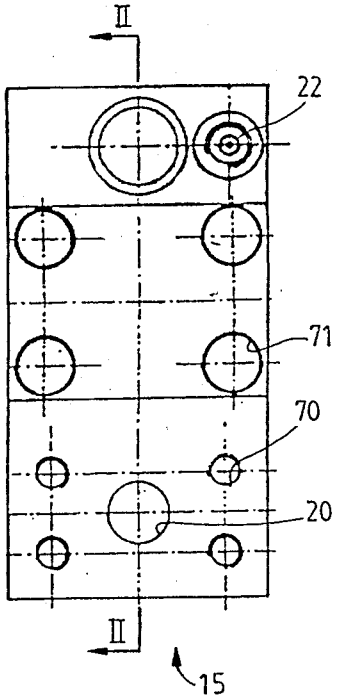
FIG. 3 is an end view of the safety valve of FIG. 2 taken in the direction of arrow III.
Figure 2:
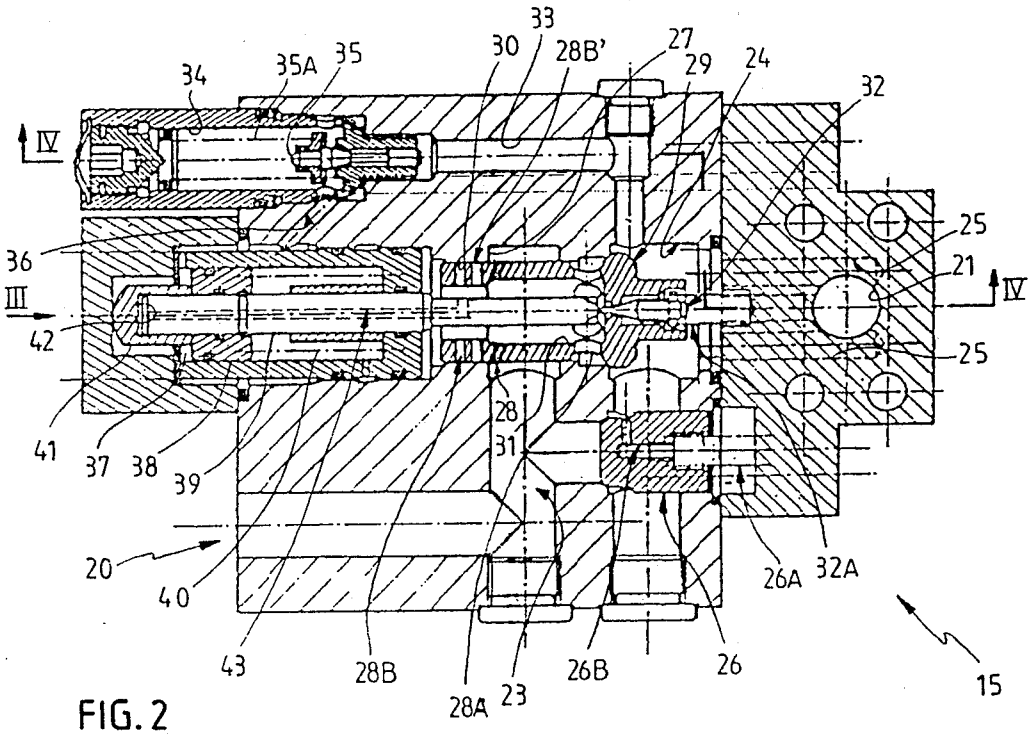
FIG. 2 is a view in cross-section taken along line II—II in FIG. 3 of another embodiment of the safety valve.
Figure 4:
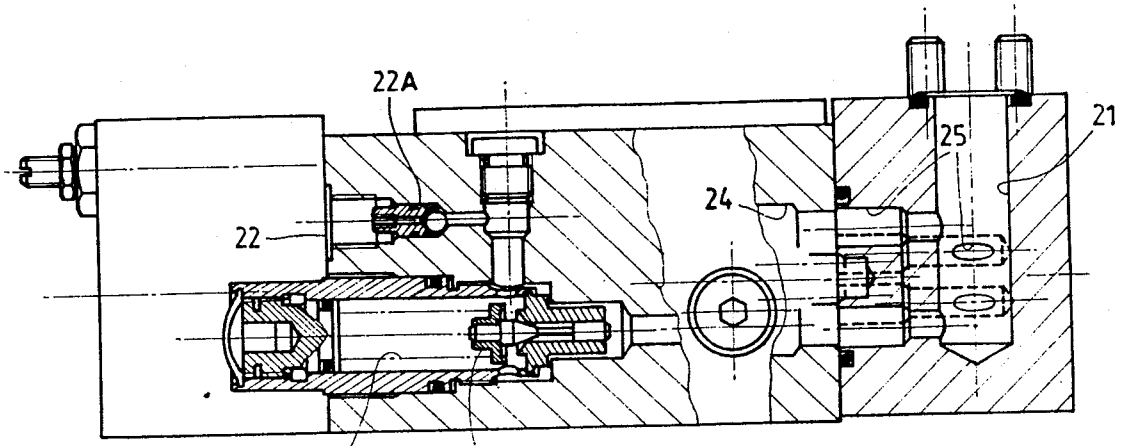
FIG. 4 is a view of the safety valve in cross-section taken along the line IV—IV in FIG. 2.

FIGS. 2 through 4 show one embodiment of the safety valve 15.

The safety valve includes an assembly of various parts in which are formed various passages connecting orifices 20, 21 and 22, respectively, corresponding to the inlets or orifices A, B and Z in FIG. 1.

The inlet orifice 20 is connected to a main passage 23 leading to a pressure chamber 24 communicating freely with the outlet orifice 21 through passages 25 situated above and below the cross-section plane of FIG. 2. A non-return valve 26 held against its seat by a spring 26A is provided in the main passage 23 between the inlet orifice 20 and the pressure chamber 24. A balancing channel 26B in the non-return valve 26 provides communication between the chamber for the spring 26A and the pressure chamber 24.

The main passage 23 also leads to a chamber 27 in which slides a sleeve 28 forming a slide valve fastened to a valve 29 which when closed prevents any reverse flow of fluid from the pressure chamber 24 to the chamber 27. Sliding of the sleeve 28 is guided in a fluid-tight way by bearing surfaces 30 and 31 lying one on either side of the communication between the main passage 23 and the chamber 27. The wall of the sleeve includes orifices 28A near the valve 29 and orifices 28B near its opposite end. A ring of orifices 28B' smaller than the orifices 28B is advantageously provided near the latter. The various orifices do not normally communicate with the main passage 23.

In the valve 29 fastened to the sleeve 28 there is provided a channel closed by a pressure balancing and control valve 32 acted on by a spring 32A and normally preventing any flow from the pressure chamber 24 to the chamber 27.

The pressure chamber 24 also communicates through a passage 33 with a control chamber 34 communicating through a throttle 22A with the control orifice 22. Flow from the pressure chamber 24 to the control chamber 34 is normally prevented by a valve 35 acted on by a calibration spring 35A.

The control chamber 34 communicates through a control channel 36 with a manipulation chamber 37 in which slides a piston 38 with a piston rod 39 and to which a return force is applied by a spring 40. The piston rod 39 extends into the chamber 27 and its end is near and aligned with the pressure balance and control valve 32 of the sleeve 28. After forcing the pressure balance and control valve 32 opens, the piston rod 39 is adapted to bear directly on the valve 29 of the slide valve and so to control its position in the chamber 27.

At the end opposite the pressure balance and control valve 32 the piston rod is slidably mounted in a cap 41 in which it defines a variable volume balancing chamber 42 communicating with the chamber 27 of the sleeve through a longitudinal balancing passage 43 in the piston rod.

The components 26, 28, 32, 38 and 39 constitute the selectively operable valve 17 from FIG. 1 except that here the non-return valve 26 is independent of the selectively operable valve. In an alternative embodiment (not shown) the non-return valve 26 and the passage section containing it can be eliminated if the orifices 28B or 28B' discharge normally between the bearing surfaces 30 and 31.

The components 33, 35, 35A and 36 constitute the pressure relief valve 18 from FIG. 1.

The throttle 22A corresponds to that designated 19 in FIG. 1.

This equipment advantageously has a four-fold function:

(a) A supply function: flow from the inlet orifice 20 to the outlet orifice 21 through the non-return valve 26.

(b) A holding function: in the absence of control pressure at the control orifice 22 the valves 26, 29 and 32 are held against their respective seats and prevent flow from the inlet orifice 20 to the outlet orifice 21.

(c) A pressure limiter function: in the event of a pressure surge in the protected chamber 1A of the hydraulic receiver or ram 1 the calibrated valve 35 opens, flow is established between this chamber of the ram and the control chamber 34 through the gap between the seat and the guide skirt of the valve 35 and through the opening in the latter. On passing through the throttle 22A this flow is subject to a head loss which varies accordingly. The pressure rise in the chamber 34 causes the valves 29 and 32 to be opened by the piston 38 and the piston rod 3. This allows flow from the outlet orifice 21 to the inlet orifice 20 whence the fluid is then evacuated either through the selectively operable valve 6 or through its pressure relief valve 7.

(d) A regulation function: for a given control pressure received from the manipulator 10 the piston rod 39 opens the valve 32, the effect of which is to balance entirely the pressure at the valve 29 of the slide valve of the sleeve 28. As a result the flow cross-section towards the main passage 23 varies with the displacement of the valve 29 according to the number of progressive orifices 28B or 28B' wholly or partly uncovered. The pressure in the chamber 27 does not alter the opening characteristic of the valve 29. The piston rod 39 is balanced at this pressure through the balancing passage 43.

This device makes it possible to ensure the safety of persons and equipment when an earthmoving machine is used to handle loads.

In the event of the flexible hose supplying the protected section of the ram rupturing, the operator can continue to put down the load which was being handled without danger to himself and persons nearby. In addition to the safety function, the device holds the load in position by virtue of the valves that close.

Figure 5:
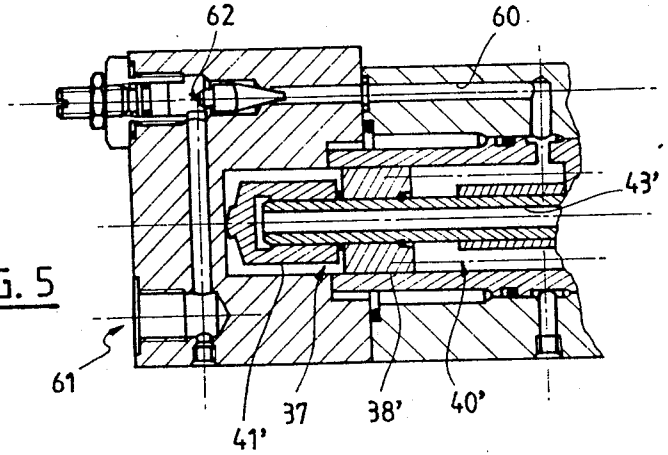
FIG. 5 is a partial view in cross-section of the safety valve illustrated schematically in FIG. 1A.

In an alternative embodiment shown in FIG. 5 corresponding to the diagram in FIG. 1A, the safety valve 15' is similar to that shown in FIGS. 2 through 4 except that the chamber 37' containing the piston 38' communicates through a passage 60 opening into the part of the chamber containing the spring 40' with a leakage orifice 61 corresponding to the orifice Y in FIG. 1A provided with a calibrated valve 62 corresponding to that designated 51 in FIG. 1A.

It is obvious that the preceding description has been given by way of non-limiting example and that numerous variations thereof may be proposed by those skilled in the art without departing from the scope of the invention.

For example, the shape and distribution of the orifices 28B and 28B' can easily be optimized to achieve improved progressive action.

What is claimed is:

1. Safety valve for a hydraulic circuit supplying a hydraulic receiver comprising an inlet and an outlet connected to said receiver and further comprising:

a non-return module disposed between said inlet and said outlet, said non-return module comprising a non-return valve and a selectively operable valve having an unoperated position in which said non-return valve prevents any reverse flow of fluid from said outlet to said inlet and an operated position in which such reverse flow is made possible, said non-return module further comprising a control inlet for applying control pressure to said selectively operable valve; and a pressure relief valve interposed said outlet and said control inlet, said pressure relief valve being adapted to enable flow from said outlet to said control inlet from a predetermined pressure threshold.

2. A safety valve according to claim 1 wherein a throttle is provided between said control inlet and said outlet, on the one hand, and said selectively operable valve, on the other hand.

3. A safety valve according to claim 1 wherein said selectively operable valve is provided with a leakage drain leading to a leakage outlet communicating with a counter-pressure chamber of said selectively operable valve.

4. A safety valve according to claim 1 wherein said selectively operable valve has at least one intermediate position allowing a reverse flow rate lower than the flow rate permitted in said operated position of said selectively operable valve, so that said reverse flow rate is variable.

5. A safety valve according to claim 1 wherein said non-return valve is part of said selectively operable valve.

6. A safety valve according to claim 1 wherein said non-return valve is independent of said selectively operable valve and included in a circuit in parallel with that including said selectively operable valve.

7. A safety valve according to claim 1 wherein said selectively operable valve further comprises a sliding sleeve forming a slide valve disposed between said inlet and said outlet having an obturation position and at least one position in which orifices allow flow between said inlet and said outlet, movement of said slide valve being controlled by a plunger acted on by a control pressure opposed by a spring return force.

8. A safety valve according to claim 7 wherein said slide valve comprises a pressure balancing valve adapted to be opened by said plunger before any movement of said slide valve takes place.

9. A safety valve according to claim 7 wherein said plunger comprises a piston rod in which is formed a pressure balancing channel adapted to provide communication between separate chambers in which said ends of the piston rod are disposed.

10. A hydraulic circuit comprising a hydraulic receiver, a supply distributor, and supply pipes and further comprising a safety valve according to claim 1 fastened to said hydraulic receiver.

11. A hydraulic circuit according to claim 10 wherein a control inlet of said safety valve is connected to a control orifice of said supply distributor.

* * * * *

UNITED STATES PATENT AND TRADEMARK OFFICE

CERTIFICATE OF CORRECTION

PATENT NO. : 4,936,032

DATED : June 26, 1990

INVENTOR(S) : Marcon et al

It is certified that error appears in the above-identified patent and that said Letters Patent is hereby corrected as shown below:

On the title page:

At area [73], delete "Bennies" and insert ---- Bennes ----.

Column 4, line 38, delete "opens" and insert ---- open ----.

Signed and Sealed this

Sixth Day of November, 1990

*Attest:*

HARRY F. MANBECK, JR.

*Attesting Officer*

*Commissioner of Patents and Trademarks*